US011404005B2

(12) United States Patent
Woo et al.

(10) Patent No.: US 11,404,005 B2
(45) Date of Patent: Aug. 2, 2022

(54) DISPLAY DEVICE

(71) Applicant: SAMSUNG DISPLAY CO., LTD., Yongin-si (KR)

(72) Inventors: Min Kyu Woo, Yongin-si (KR); Hyun Joon Kim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/142,530

(22) Filed: Jan. 6, 2021

(65) Prior Publication Data

US 2021/0343240 A1 Nov. 4, 2021

(30) Foreign Application Priority Data

Apr. 29, 2020 (KR) ..... 10-2020-0052784

(51) Int. Cl.
*G09G 3/3258* (2016.01)
*G09G 3/3275* (2016.01)
*G09G 3/3266* (2016.01)

(52) U.S. Cl.
CPC ..... *G09G 3/3258* (2013.01); *G09G 3/3266* (2013.01); *G09G 3/3275* (2013.01); *G09G 2300/0809* (2013.01); *G09G 2320/0257* (2013.01)

(58) Field of Classification Search
None
See application file for complete search history.

(56) References Cited

U.S. PATENT DOCUMENTS 9,111,492 B2 8/2015 Kim
2007/0063993 A1* 3/2007 Shishido ..... G09G 3/3241 345/175
2009/0219232 A1* 9/2009 Choi ..... G09G 3/3266 345/76
2012/0162177 A1 6/2012 Lee
2018/0061915 A1* 3/2018 Yu ..... H01L 27/3248
2019/0131376 A1* 5/2019 Hong ..... G09G 3/3275
(Continued)

FOREIGN PATENT DOCUMENTS

CN 109087610 12/2018
KR 10-1797161 11/2017
(Continued)

*Primary Examiner* — Nitin Patel
*Assistant Examiner* — Amen W Bogale
(74) *Attorney, Agent, or Firm* — F. Chau & Associates, LLC

(57) ABSTRACT

A display device including: a pixel connected to first, second and third scan lines, a data line, and an emission line, the pixel including: an LED; a first transistor including a first electrode connected to a first node, a second electrode connected to a second node, and a gate electrode connected to a third node; a second transistor connected between the data line and the first node and including a gate electrode connected to the first scan line; a third transistor connected between the second node and the third node and including a gate electrode connected to the second scan line; a fourth transistor connected between the second node and a power source and including a gate electrode connected to the third scan line; and a fifth transistor connected between the second node and an anode of the LED and including a gate electrode connected to the second scan line.

19 Claims, 8 Drawing Sheets

(56) References Cited

U.S. PATENT DOCUMENTS

| | | | | |
|---|---|---|---|---|
| 2021/0082339 | A1* | 3/2021 | Zhang | G09G 3/2092 |
| 2021/0193055 | A1* | 6/2021 | Lee | G09G 3/3233 |
| 2021/0241689 | A1* | 8/2021 | Lee | H01L 27/1225 |
| 2021/0312868 | A1 | 10/2021 | Kim et al. | |
| 2022/0051633 | A1* | 2/2022 | Li | G09G 3/3266 |

FOREIGN PATENT DOCUMENTS

| | | |
|---|---|---|
| KR | 10-2024240 | 9/2019 |
| KR | 10-2021-0124599 | 10/2021 |

* cited by examiner

DISPLAY DEVICE

CROSS-REFERENCE TO RELATED APPLICATION

The present application claims priority under 35 U.S.C. § 119 to Korean Patent Application No. 10-2020-0052784, filed in the Korean Intellectual Property Office on Apr. 29, 2020, the disclosure of which is incorporated by reference herein in its entirety.

TECHNICAL FIELD

The present invention relates to a display device, and more particularly, to a pixel capable of displaying an image with a desired luminance and an organic light emitting display device having the same.

DESCRIPTION OF THE RELATED ART

As information technology develops, display devices, which are a connection medium between users and information, play a major role. Accordingly, the use of high quality display devices such as a liquid crystal display device, an organic light emitting display device, and the like has been increasing.

Among the display devices, the organic light emitting display device displays an image using an organic light emitting diode that generates light by recombination of electrons and holes. For example, the organic light emitting diode includes an emissive electroluminescent layer of an organic compound that emits light in response to electric current. The organic light emitting display device has a fast response speed and is driven with low power.

The organic light emitting display device includes pixels connected to data lines and scan lines which are also known as gate lines. Each pixel may include a single organic light emitting diode and a driving transistor for controlling the amount of current flowing through the organic light emitting diode. The pixel generates light having a predetermined luminance while the current is supplied from the driving transistor to the organic light emitting diode in response to a data signal.

The pixel may further include a plurality of transistors and a plurality of capacitors to compensate for a deviation in a threshold voltage of the driving transistor. However, as more transistors are included in a single pixel, the pixel's application to a high resolution panel is limited.

SUMMARY

According to an exemplary embodiment of the present invention, there is provided a display device including: a pixel connected to a first scan line, a second scan line, a third scan line, a data line, and an emission control line, wherein the pixel includes: a light emitting diode; a first transistor including a first electrode connected to a first node, a second electrode connected to a second node, and a gate electrode connected to a third node, wherein the first node is electrically connected to a first power source; a second transistor connected between the data line and the first node and including a gate electrode connected to the first scan line; a third transistor connected between the second node and the third node and including a gate electrode connected to the second scan line; a fourth transistor connected between the second node and a third power source and including a gate electrode connected to the third scan line; and a fifth transistor connected between the second node and an anode of the light emitting diode and including a gate electrode connected to the second scan line, wherein a turn-on period of the third transistor does not overlap a turn-on period of the fifth transistor.

The display device may further include: a sixth transistor connected between the first node and the first power source and including a gate electrode connected to the emission control line.

The third transistor may be turned on when the fourth transistor is turned on, and the fifth transistor may be turned on when the third transistor is turned off.

The first transistor, the second transistor, the fourth transistor, the fifth transistor, and the sixth transistor may be P-type Low-Temperature Poly-Silicon (LTPS) thin film transistors, and the third transistor may be an N-type oxide semiconductor thin film transistor.

The display device may further include: a storage capacitor connected between the first power source and the third node.

A cathode of the light emitting diode may be electrically connected to a second power source.

A voltage of the first power source may be higher than a voltage of the second power source.

The display device may further include: a data driver for supplying a data signal corresponding to a grayscale of an image to the data line.

A voltage of the third power source may be lower than a voltage of the data signal.

The display device may further include: a scan driver for supplying a first scan signal, a second scan signal, and a third scan signal to the first scan line, the second scan line, and the third scan line, respectively, during a frame period including a non-emission period and an emission period.

The non-emission period may include a first period in which the anode of the light emitting diode is initialized, a second period in which the gate electrode of the first transistor is initialized, and a third period in which the data signal supplied from the data line to the gate electrode of the first transistor is stored, and the emission period may include a fourth period during which the light emitting diode emits light.

The display device may further include: an emission driver for supplying an emission control signal to the emission control line, wherein the emission control signal of a logic high level is supplied during the non-emission period, and the emission control signal of a logic low level is supplied during the emission period.

During the first period the second scan signal may have a logic low level, and the third scan signal may have the logic low level.

During the second period the second scan signal may have a logic high level, and the third scan signal may have a logic low level.

During the third period the first scan signal may have a logic low level, and the second scan signal may have a logic high level.

During the non-emission period the first scan signal and the third scan signal may be alternately supplied, and the second scan signal and the third scan signal may be supplied to overlap in some periods.

The display device may further include: a scan driver for supplying two or more first scan pulses, one second scan pulse, and two or more third scan pulses to the first scan line, the second scan line, and the third scan line, respectively, during a frame period including a non-emission period and an emission period.

The display device may further include: an emission driver for supplying an emission control pulse to the emission control line during the non-emission period.

During the non-emission period the first scan pulses and the third scan pulses may be alternately supplied, and a first scan pulse among the two or more third scan pulses may partially overlap the second scan pulse.

In the emission period, the light emitting diode may emit light at a grayscale corresponding to a voltage of the third node when the last scan pulse among the two or more first scan pulses is supplied.

According to an exemplary embodiment of the present invention, there is provided a display device including: a pixel, wherein the pixel includes: a light emitting diode; a third transistor connected between a second node and a third node; a fourth transistor connected between the second node and a third power source; and a fifth transistor connected between the second node and an anode of the light emitting diode.

A type of the third transistor may be different from a type of the fifth transistor.

A turn-on period of the third transistor may not overlap a turn-on period of the fifth transistor.

BRIEF DESCRIPTION OF THE DRAWINGS

The above and other features of the present invention will become more apparent by describing in detail exemplary embodiments thereof with reference to the accompanying drawings.

DETAILED DESCRIPTION OF THE EMBODIMENTS

Figure 1:
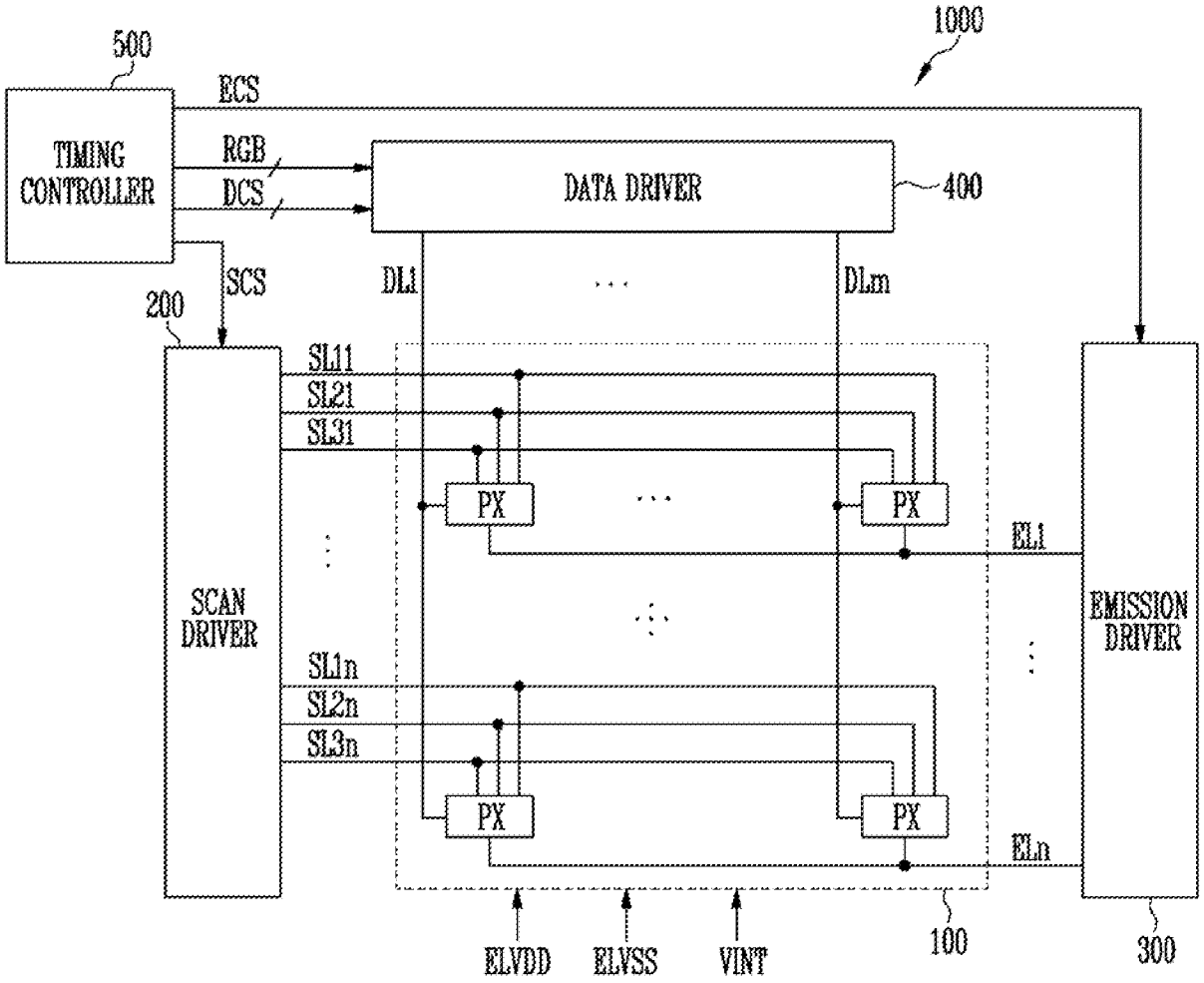
FIG. 1 is a block diagram illustrating a display device according to an exemplary embodiment of the present invention.

Hereinafter, exemplary embodiments of the present invention will be described in detail with reference to the accompanying drawings. Throughout the specification, the same reference numerals may be used to refer to the same components, and thus, duplicate descriptions for the same components may be omitted.

FIG. 1 is a block diagram illustrating a display device according to an exemplary embodiment of the present invention.

Referring to FIG. 1, a display device 1000 may include a pixel unit 100, a scan driver 200, an emission driver 300, a data driver 400, and a timing controller 500.

In an exemplary embodiment of the present invention, the display device 1000 may further include a power supply unit that supplies voltages of a first power source ELVDD, a second power source ELVSS, and a third power source VINT to the pixel unit 100. However, this is an example, and at least one of the voltages of the first power source ELVDD, the second power source ELVSS, and the third power source VINT may be supplied from the timing controller 500 or the data driver 400. For example, the voltage of the first power source ELVDD may be supplied from the timing controller 500 and the voltage of the second power source ELVSS may be supplied from the data driver 400.

The pixel unit 100 may include a plurality of first scan lines SL11 to SL1*n*, a plurality of second scan lines SL21 to SL2*n*, a plurality of third scan lines SL31 to SL3*n*, a plurality of emission control lines EL1 to ELn, a plurality of data lines DL1 to DLm. In addition, the pixel unit 100 may include a plurality of pixels PX respectively connected to the first scan lines SL11 to SL1*n*, the second scan lines SL21 to SL2*n*, the third scan lines SL31 to SL3*n*, the emission control lines EL1 to ELn, and the data lines DL1 to DLm, where n and m are integers greater than 1. For example, a first pixel of the pixels PX may be connected to the first scan line SL11, the second scan line SL21, the third scan line SL13, the data line DL1 and the emission control line ELL Each of the pixels PX may include a driving transistor and a plurality of switching transistors.

The scan driver 200 may sequentially supply scan signals to the pixels PX through the first scan lines SL11 to SL1*n*, the second scan lines SL21 to SL2*n*, and the third scan lines SL31 to SL3*n* based on a first control signal SCS. The scan driver 200 may receive the first control signal SCS and at least one clock signal from the timing controller 500.

In an exemplary embodiment of the present invention, a scan signal supplied to one scan line during one frame period may include at least one scan pulse. For example, the scan signal may include first scan signals sequentially supplied to the first scan lines SL11 to SL1*n*, second scan signals sequentially supplied to the second scan lines SL21 to SL2*n*, and third scan signals sequentially supplied to the third scan lines SL31 to SL3*n*.

The first scan signals may include at least one first scan pulse, the second scan signals may include at least one second scan pulse, and the third scan signals may include at least one third scan pulse.

Here, the first scan pulse, the second scan pulse, and the third scan pulse may be a gate-on voltage for turning on transistors included in the pixels PX. For example, when the transistors included in the pixels PX are P-channel metal oxide semiconductor (PMOS) transistors, the gate-on voltage may be set to a logic low level, while the gate-off voltage may be set to a logic high level. When the transistors included in the pixels PX are N-channel metal oxide semiconductor (NMOS) transistors, the gate-on voltage may be set to a logic high level, while the gate-off voltage may be set to a logic low level.

In an exemplary embodiment of the present invention, the scan driver 200 may include first stages connected to each other to sequentially output the first scan signals (e.g., first scan pulses) to the first scan lines SL11 to SL1*n*, second stages connected to each other to sequentially output the second scan signals (e.g., second scan pulses) to the second scan lines SL21 to SL2*n*, and third stages connected to each other to sequentially output the third scan signals (e.g., third scan pulses) to the third scan lines SL31 to SL3*n*.

The emission driver 300 may sequentially supply emission control signals to the pixels PX through the emission control lines EL1 to ELn based on a second control signal ECS. The emission driver 300 may receive the second control signal ECS, a clock signal, and the like from the timing controller 500. The emission control signals may divide one frame period into an emission period and a non-emission period for the pixels located on the same horizontal line (e.g., the same row). For example, in response to the emission control signals, one frame period may start as a non-emission frame period and then switch to an emission frame period.

The data driver 400 may receive a third control signal DCS and an image data signal RGB from the timing controller 500. The data driver 400 may supply data signals (or data voltages) to the pixels PX through the data lines DL1 to DLm based on the third control signal DCS and the image data signal RGB. In an exemplary embodiment of the present invention, the data driver 400 may supply the data signals corresponding to a grayscale of an image to the data lines DL1 to DLm. For example, a data signal of a corresponding pixel PX may be supplied to the corresponding pixel PX in synchronization with each of the first scan signals (the first scan pulses).

The timing controller 500 may control driving of the scan driver 200, the emission driver 300, and the data driver 400 based on timing signals supplied from outside. The timing controller 500 may supply control signals including the first control signal SCS and a scan clock signal to the scan driver 200, and supply control signals including the second control signal ECS and an emission control clock signal to the emission driver 300. The third control signal DCS for controlling the data driver 400 may include a source start signal, a source output enable signal, a source sampling clock, and the like.

Figure 2:
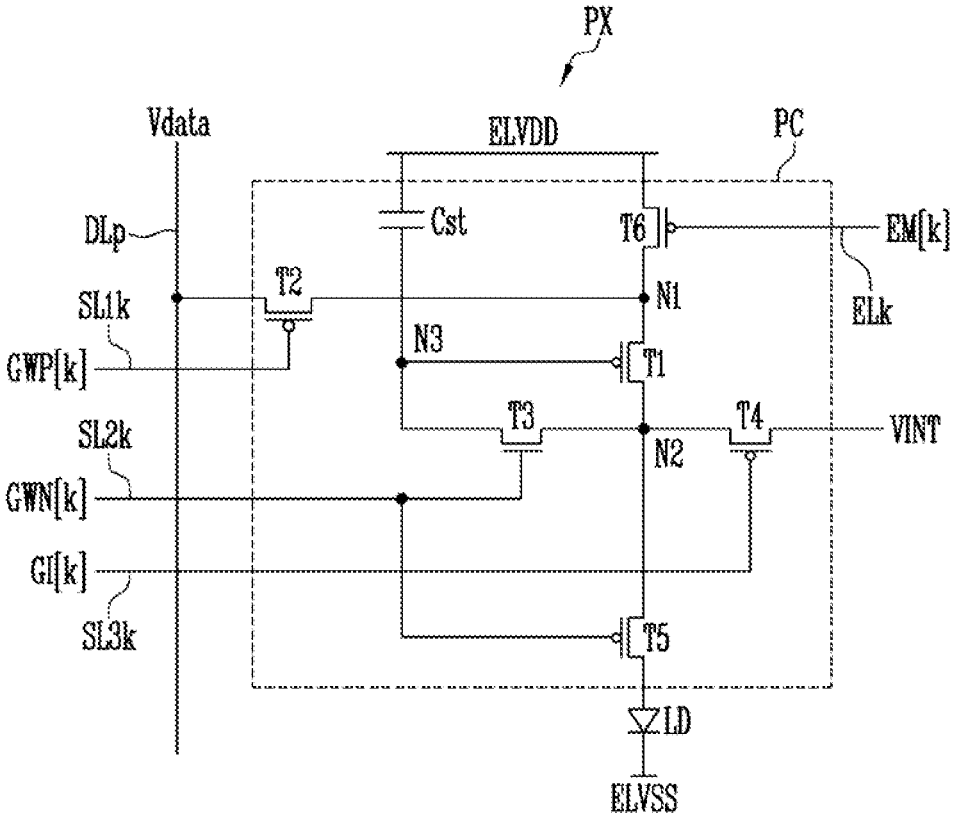
FIG. 2 is a circuit diagram illustrating a pixel included in the display device shown in FIG. 1, according to an exemplary embodiment of the present invention.

FIG. 2 is a circuit diagram illustrating a pixel included in the display device shown in FIG. 1, according to an exemplary embodiment of the present invention.

Referring to FIGS. 1 and 2, a pixel PX may include a light emitting diode LD and a pixel circuit PC connected to the light emitting diode LD.

The pixel PX shown in FIG. 2 may be a pixel arranged in a k-th row and a p-th column of the pixel unit 100, where k and p are natural numbers.

An anode of the light emitting diode LD may be connected to the pixel circuit PC, and a cathode electrode of the light emitting diode LD may be connected to the second power source ELVSS. In other words, a first electrode of the light emitting diode LD may be connected to the pixel circuit PC, and a second electrode of the light emitting diode LD may be connected to the second power source ELVSS. The light emitting diode LD may generate light having a predetermined luminance corresponding to the amount of current supplied from the pixel circuit PC.

The pixel circuit PC may control the amount of current flowing from the first power source ELVDD to the second power source ELVSS via the light emitting diode LD in response to a data signal Vdata. To accomplish this, the first power source ELVDD may be set to a voltage higher than the second power source ELVSS.

The pixel circuit PC may include first, second, third, fourth, fifth and sixth transistors T1, T2, T3, T4, T5 and T6 and a storage capacitor Cst.

The first transistor T1 may be coupled between a first node N1 electrically connected to the first power source ELVDD via the sixth transistor T6 and a second node N2 electrically connected to the anode of the light emitting diode LD via the fifth transistor T5. For example, a first electrode of the first transistor T1 may be connected to the first node N1 and a second electrode of the first transistor T1 may be connected to the second node N2. A gate electrode of the first transistor T1 may be coupled to a third node N3. The first transistor T1 may provide a driving current corresponding to a voltage of the third node N3 to the light emitting diode LD. The first transistor T1 may function as a driving transistor of the pixel PX.

The second transistor T2 may be coupled between a p-th data line DLp and the first node N1. For example, a first electrode of the second transistor T2 may be connected to the p-th data line DLp and a second electrode of the second transistor T2 may be connected to the first node N1. The second transistor T2 may include a gate electrode for receiving a first scan signal GWP[k]. The first scan signal GWP[k] may be provided to the gate electrode of the second transistor T2 from a k-th first scan line SLik. When the second transistor T2 is turned on, the data signal Vdata may be transferred to the first node N1.

The third transistor T3 may be coupled between the second node N2 and the third node N3. For example, a first electrode of the third transistor T3 may be connected to the second node N2 and a second electrode of the third transistor T3 may be connected to the third node N3. The third transistor T3 may include a gate electrode for receiving a second scan signal GWN[k]. The second scan signal GWN [k] may be provided to the gate electrode of the third transistor T3 from a k-th second scan line SL2*k*. The third transistor T3 may be turned on by the second scan signal GWN[k] to electrically connect an electrode (e.g., the second node N2) of the first transistor T1 and the third node N3. Therefore, when the third transistor T3 is turned on, the first transistor T1 may be connected in the form of a diode.

The storage capacitor Cst may be connected between the first power source ELVDD and the third node N3. The storage capacitor Cst may store a voltage corresponding to a difference between the data signal Vdata and a threshold voltage of the first transistor T1.

Figure 3:
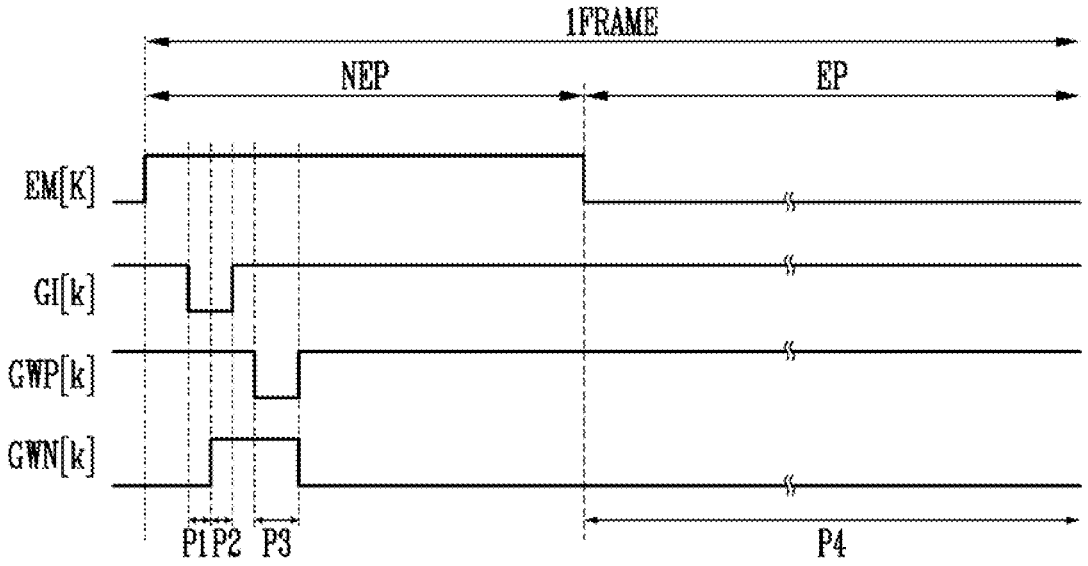
FIG. 3 is a timing diagram of driving the display device shown in FIG. 1, according to an exemplary embodiment of the present invention.

The fourth transistor T4 may be coupled between the second node N2 and the third power source VINT. For example, a first electrode of the fourth transistor T4 may be connected to the second node N2 and a second electrode of the fourth transistor T4 may be connected to the third power source VINT. The fourth transistor T4 may include a gate electrode for receiving a third scan signal GI[k]. The third scan signal GI[k] may be provided via a k-th third scan line SL3*k*. Referring to FIG. 3, the third scan signal GI[k] may correspond to the first scan signal GWP[k-1] of a previous pixel row. The fourth transistor T4 may be turned on when the third scan signal GI[k] is supplied to supply a voltage of the third power source VINT to the second node N2.

The second scan signal GWN[k] may be set to a logic low level for some of the time when the third scan signal GI[k] is supplied, and the second scan signal GWN[k] may be set to a logic high level for the remainder of the time when the third scan signal GI[k] is supplied.

During a period in which the second scan signal GWN[k] is set to the logic low level, the fifth transistor T5 may be turned on to initialize the anode of the light emitting diode LD. During a period in which the second scan signal GWN[k] is set to the logic high level, the third transistor T3 may be turned on to initialize the third node N3. Accordingly, a voltage of the anode of the light emitting diode LD and the third node N3 (in other words, a gate voltage of the first transistor T1) may be initialized to a voltage of the third power source VINT. In an exemplary embodiment of the present invention, the third power source VINT may be set to a voltage lower than the lowest voltage of the data signal Vdata.

The fifth transistor T5 may be coupled between the second node N2 and the anode of the light emitting diode LD. For example, a first electrode of the fifth transistor T5 may be connected to the second node N2 and a second electrode of the fifth transistor T5 may be connected to the anode of the light emitting diode LD. The fifth transistor T5 may include a gate electrode for receiving the second scan signal GWN [k]. The fifth transistor T5 may be turned on when the second scan signal GWN[k] is set to the low logic level to electrically connect the second node N2 and the anode of the light emitting diode LD.

The sixth transistor T6 may be coupled between the first power source ELVDD and the first node N1. For example, a first electrode of the sixth transistor T6 may be connected to the first power source ELVDD and a second electrode of the sixth transistor T6 may be connected to the first node N1. The sixth transistor T6 may include a gate electrode for receiving an emission control signal EM[k]. The emission control signal EM[k] may be provided via a k-th emission control line EM[k]. The sixth transistor T6 may be turned on when the emission control signal EM[k] is at the logic low level, and turned off when the emission control signal EM[k] is at the logic high level.

The light emitting diode LD may be coupled between the fifth transistor T5 and the second power source ELVSS. The cathode of the light emitting diode LD may be applied with the second power source ELVSS. The first power source ELVDD and the second power source ELVSS may have different potentials. For example, the first power source ELVDD may be a high potential power source, and the second power source ELVSS may be a low potential power source. In this case, a potential difference between the first and second power sources ELVDD and ELVSS may be equal to or higher than a threshold voltage of the light emitting diode LD during an emission period of the pixel PX. In an exemplary embodiment of the present invention, the first, second, fourth, fifth, and sixth transistors T1, T2, T4, T5, and T6 may be P-type LTPS (Low-Temperature Poly-Silicon) thin film transistors, and the third transistor T3 may be an N-type oxide semiconductor thin film transistor. The N-type oxide semiconductor thin film transistor may have better current leakage characteristics than the P-type LTPS thin film transistor. Therefore, when the third transistor T3 connected to the third node N3 is formed of the N-type oxide semiconductor thin film transistor, leakage current flowing from the third node N3 to the second node N2 may be greatly reduced, so that power consumption can be reduced.

In general, to initialize the gate electrode (or the third node N3) of the first transistor T1 to the third power source VINT, an initialization transistor directly connected to the third node N3 may be further provided. However, when the initialization transistor is additionally provided, the leakage current may be additionally generated by a current path from the third node N3 to the third power source VINT.

In addition, the initialization transistor may be formed of the N-type oxide semiconductor thin film transistor to minimize the leakage current. However, in this case, since an extra transistor is employed an area of the pixel is increased.

In contrast, according to an exemplary embodiment of the present invention, the third node N3 and the anode of the light emitting diode LD may be initialized using the fourth transistor T4 connected to the second node N2. In other words, according to the embodiment of the present invention shown in FIG. 2, the initialization transistor connected to the third node N3 can be removed, and accordingly, an area of the pixel PX is decreased and the pixel PX can be applied to the high resolution panel.

Further, the fourth transistor T4 may be indirectly connected to the gate electrode (or the third node N3) of the first transistor T1 via the third transistor T3. Therefore, the fourth transistor T4 may be not required to be formed of the N-type oxide semiconductor thin film transistor to prevent the leakage current.

In general, the N-type oxide semiconductor thin film transistor takes up mode space in the pixel circuit than the P-type LIPS thin film transistor. Accordingly, when the number of oxide semiconductor thin film transistors formed in a unit pixel circuit is reduced, the size of the unit pixel circuit can be reduced. Therefore, a high resolution (or more highly integrated pixel circuit) the display device 1000 can be achieved.

According to an exemplary embodiment of the present invention, the display device 1000 may include a pixel PX connected to a first scan line SL1*k*, a second scan line SL2*k*, a third scan line SL3*k*, a data line DLp, and an emission control line ELk. The pixel PX may include: a light emitting diode LD; a first transistor T1 including a first electrode connected to a first node N1, a second electrode connected to a second node N2, and a gate electrode connected to a third node N3, wherein the first node N3 is electrically connected to a first power source ELVDD; a second transistor T2 connected between the data line DLp and the first node N1 and including a gate electrode connected to the first scan line SL1*k*; a third transistor T3 connected between the second node N2 and the third node N3 and including a gate electrode connected to the second scan line SL2*k*; a fourth transistor T4 connected between the second node N2 and a third power source VINT and including a gate electrode connected to the third scan line SL3*k*; and a fifth transistor T5 connected between the second node N2 and an anode of the light emitting diode LD and including a gate electrode connected to the second scan line SL2*k*.

Hereinafter, a driving method of the display device 1000 including the pixel PX shown in FIG. 2 will be described in detail.

FIG. 3 is a timing diagram of driving the display device shown in FIG. 1, according to an exemplary embodiment of the present invention.

Referring to FIGS. 1 to 3, one frame period of the display device 1000 may include an emission period EP and a non-emission period NEP.

The non-emission period NEP may be divided into a first period P1, a second period P2, and a third period P3 for driving, and the emission period EP may include a fourth period P4.

FIG. 3 shows an example of signals supplied to the pixel PX included in the k-th row of the pixel unit 100.

In FIG. 3, the lengths of the emission period EP and the non-emission period NEP included in one frame period are shown similarly to each other. However, it should be understood that the length of the emission period EP is substantially longer than the length of the non-emission period NEP.

In the first period P1, the anode of the light emitting diode LD may be initialized to the third power source VINT. In the second period P2, the gate electrode (or the third node N3) of the first transistor T1 may be initialized to the third power source VINT. In the third period P3, a voltage corresponding to the data signal Vdata and the threshold voltage of the first transistor T1 may be stored in the storage capacitor Cst. In the fourth period P4, a predetermined current may be supplied from the first transistor T1 to the light emitting diode LD in response to the voltage of the third node N3. In this case, the light emitting diode LD may generate light having a predetermined luminance corresponding to the amount of current supplied from the first transistor T1.

FIGS. 4 to 7 are diagrams of an operation process according to the pixel shown in FIG. 2 and the timing diagram of the display device shown in FIG. 3, according to an exemplary embodiment of the present invention.

Referring to FIGS. 1 to 7, since the first, second, fourth, and sixth transistors T1, T2, T4, and T6 are the P-type LIPS transistors, gate-on voltages of the first scan signal GWP[k] and the third scan signal GI[k] may be the logic low level. Similarly, the gate-on voltage of the emission control signal EM[k] may be the logic low level.

Since the third transistor T3 is the N-type oxide semiconductor thin film transistor, the gate-on voltage of the second scan signal GWN[k] may be the logic high level. However, since the fifth transistor T5 is the P-type LIPS transistor, in this case, the gate-on voltage of the second scan signal GWN[k] may be the logic low level.

Figure 4:
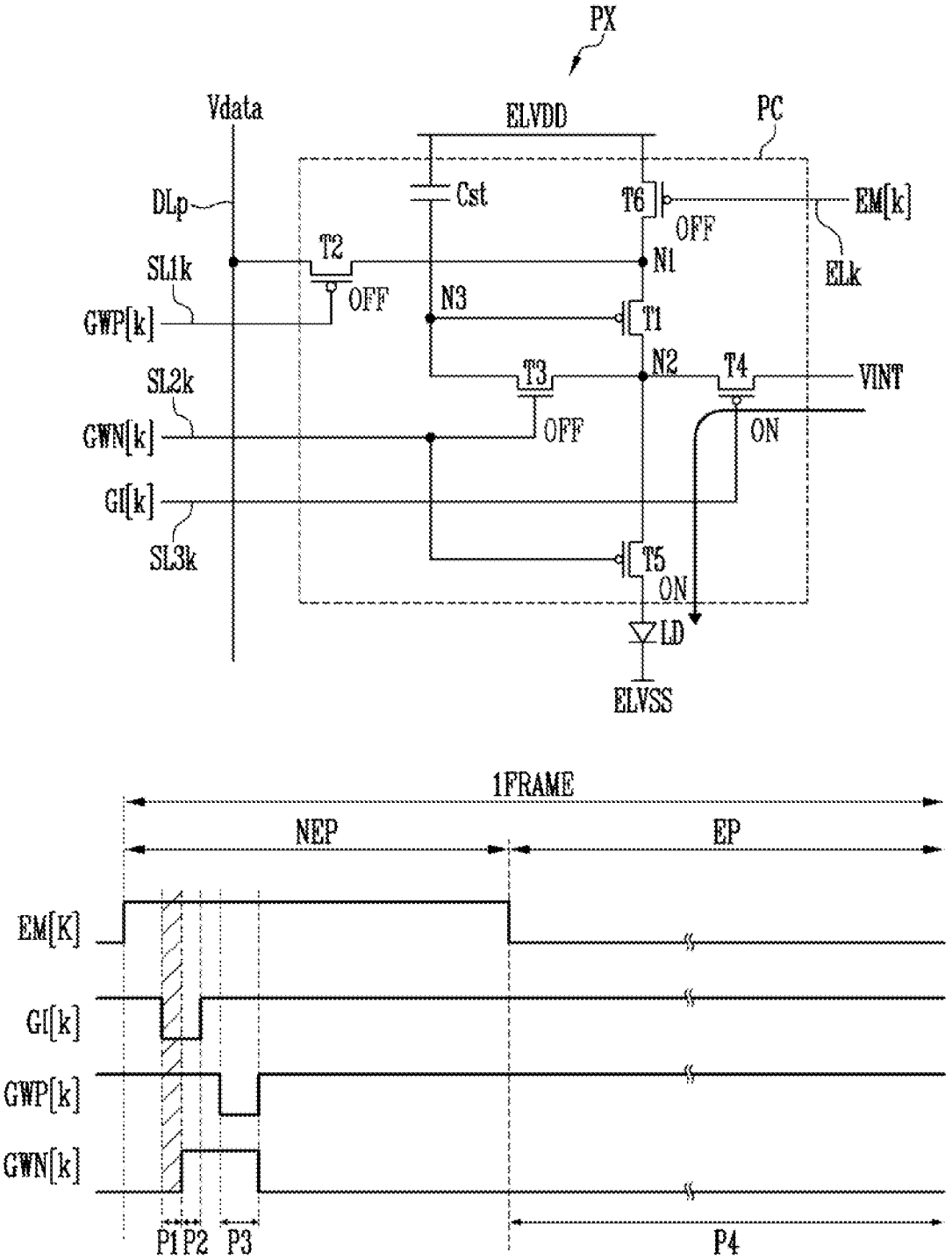
FIGS. 4, 5, 6 and 7 are diagrams illustrating an operation process of the pixel shown in FIG. 2 and the timing diagram of the display device shown in FIG. 3, according to an exemplary embodiment of the present invention.

Referring to FIG. 4, during the non-emission period NEP, the emission control signal EM[k] of the logic high level may be supplied to the emission control line ELk. When the emission control signal EM[k] of the logic high level is supplied to the emission control line ELk, the sixth transistor T6 may be turned off. When the sixth transistor T6 is turned off, current does not flow from the first power source ELVDD to the first transistor T1. Accordingly, the light emitting diode LD may maintain a non-light emitting state.

In the first period P1, the third scan signal GI[k] of the logic low level may be supplied to the third scan line SL3*k*. Also in the first period P1, the first scan signal GWP[k] of the logic high level may be supplied to the first scan line SL1*k*, and the second scan signal GWN[k] of the logic low level may be supplied to the second scan line SL2*k*.

When the third scan signal GI[k] of the logic low level is supplied to the third scan line SL3*k*, the fourth transistor T4 may be turned on. When the fourth transistor T4 is turned on, the third power source VINT may be supplied to the second node N2. The application of the third power source VINT is illustrated by the arrow in FIG. 4.

For example, since the fifth transistor T5 is set to a turn-on state by the second scan signal GWN[k] of the logic low level, the third power source VINT supplied to the second node N2 may be supplied to the anode of the light emitting diode LD via the fifth transistor T5.

In addition, when the second scan signal GWN[k] of the logic low level is supplied to the second scan line SL2*k*, the third transistor T3 may be set to a turn-off state. Therefore, the electrical connection between the third power source VINT supplied to the second node N2 and the third node N3 may be cut off.

Figure 5:
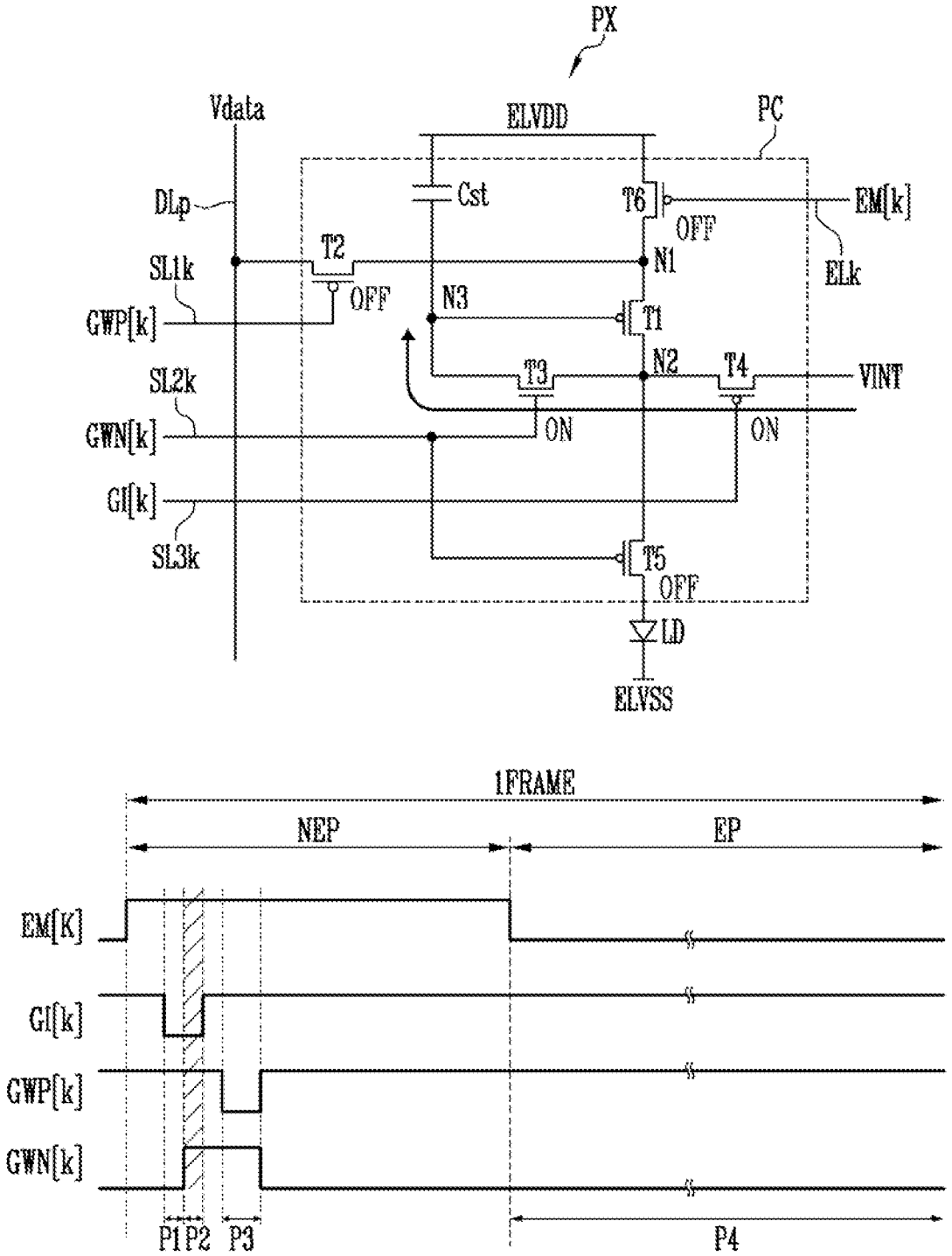

Referring to FIG. 5, the third scan signal GI[k] supplied to the third scan line SL3*k* may be maintained in the second period P2. In other words, the third scan signal GI[k] may be kept low. In addition, the second scan signal GWN[k] of the logic high level may be supplied to the second scan line SL2*k* in the second period P2. In other words, the second scan signal GWN[k] may transition from the low level to the high level in the second period P2.

When the third scan signal GI[k] supplied to the third scan line SL3*k* is maintained at the low level, the fourth transistor T4 may maintain the turn-on state. When the fourth transistor T4 maintains the turn-on state, the third power source VINT may still be supplied to the second node N2. This is illustrated by the arrow in FIG. 5.

When the second scan signal GWN[k] of the logic high level is supplied to the second scan line SL2*k*, the third transistor T3 may be turned on and the fifth transistor T5 may be turned off. When the fifth transistor T5 is turned off, the electrical connection between the third power source VINT supplied to the second node N2 and the anode of the light emitting diode LD may be cut off. However, since the third transistor T3 is turned on, the third power source VINT supplied to the second node N2 and the gate electrode of the first transistor T1 may be electrically connected. Accordingly, the gate electrode (or the third node N3) of the first transistor T1 may be initialized to the third power source VINT in the second period P2.

After the second period P2, the third scan signal GI[k] may be changed to the logic high level, and accordingly, the fourth transistor T4 may be turned off.

In an exemplary embodiment of the present invention, a period in which the fourth transistor T4 is turned on may be divided into the first period P1 and the second period P2, and the anode of the light emitting diode LD may be initialized during the first period P1 and the third node N3 may be initialized during the second period P2. In other words, the anode of the light emitting diode LD is provided with the voltage of the third power source VINT passing through the fourth transistor T4 and the fifth transistor T5 in the first period P1, and the third node N3 is provided with the voltage of the third power source VINT passing through the third transistor T3 and the fourth transistor T4 in the second period P2. In this case, the anode of the light emitting diode LD and the third node N3 may be initialized by one fourth transistor T4. Therefore, the number of transistors included in the unit pixel circuit can be reduced. When the number of transistors formed in the unit pixel circuit is reduced, the size of the unit pixel circuit can be reduced. Therefore, a high resolution (or highly integrated pixel circuit) display device 1000 can be realized.

Figure 6:
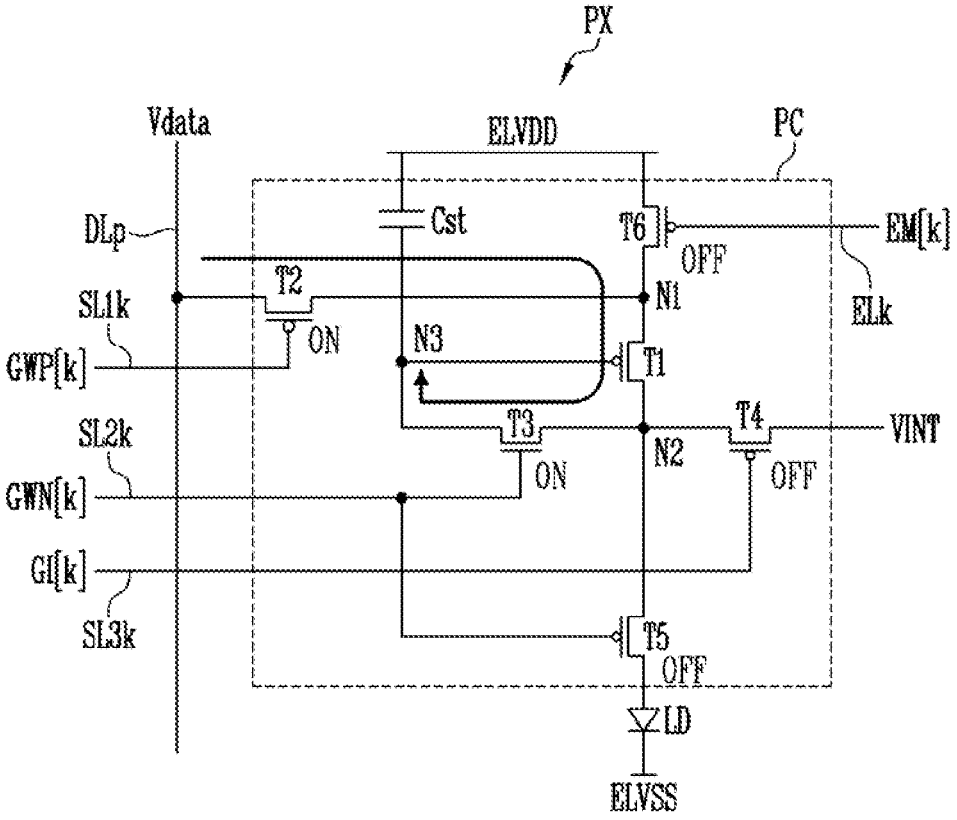
Figure 6:
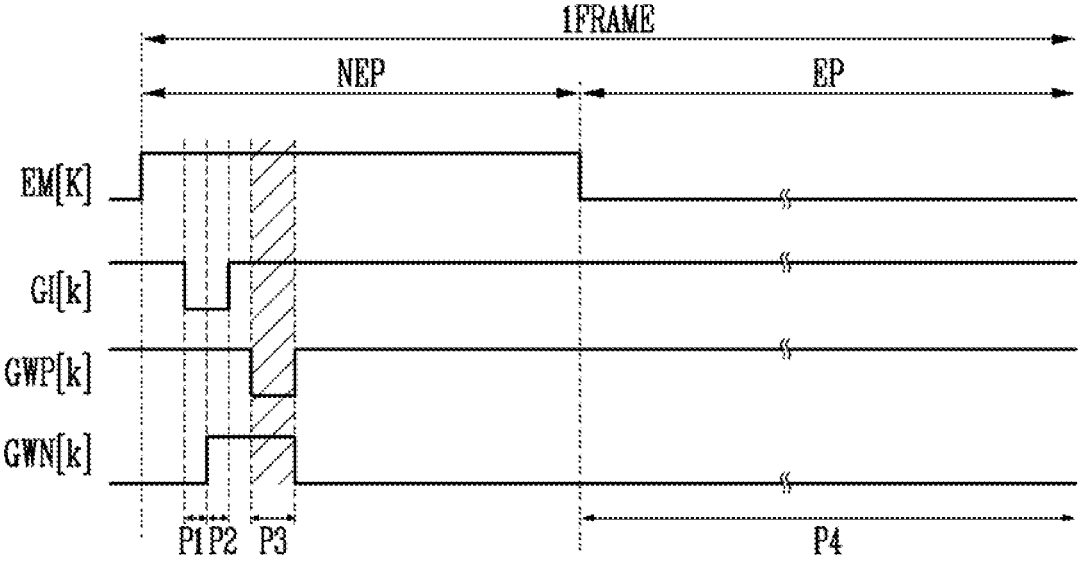

Referring to FIG. 6, in the third period P3, the first scan signal GWP[k] may be supplied to the first scan line SL1*k*. For example, the first scan signal GWP[k] of the low level is supplied to the first scan line SL1*k*. At this time, the second scan signal GWN[k] may maintain the logic high level.

In this case, when the first scan signal GWP[k] of the logic low level is supplied to the first scan line SL1*k*, the second transistor T2 may be turned on. When the second scan signal GWN[k] supplied to the second scan line SL2*k* maintains the logic high level, the third transistor T3 may maintain the turn-on state, and the fifth transistor T5 may maintain the turn-off state. When the third transistor T3 is turned on, the first transistor T1 may be connected in the form of a diode. Accordingly, in the third period P3, the voltage corresponding to the difference between the data signal Vdata and the threshold voltage of the first transistor T1 may be stored in the storage capacitor Cst. This is illustrated by the arrow in FIG. 6.

After the third period P3, the first scan signal GWP[k] may be changed to the logic high level, and accordingly, the second transistor T2 may be turned off. In addition, the second scan signal GWN[k] may be changed to the logic low level, and accordingly, the third transistor T3 may be turned off and the fifth transistor T5 may be turned on.

Figure 7:
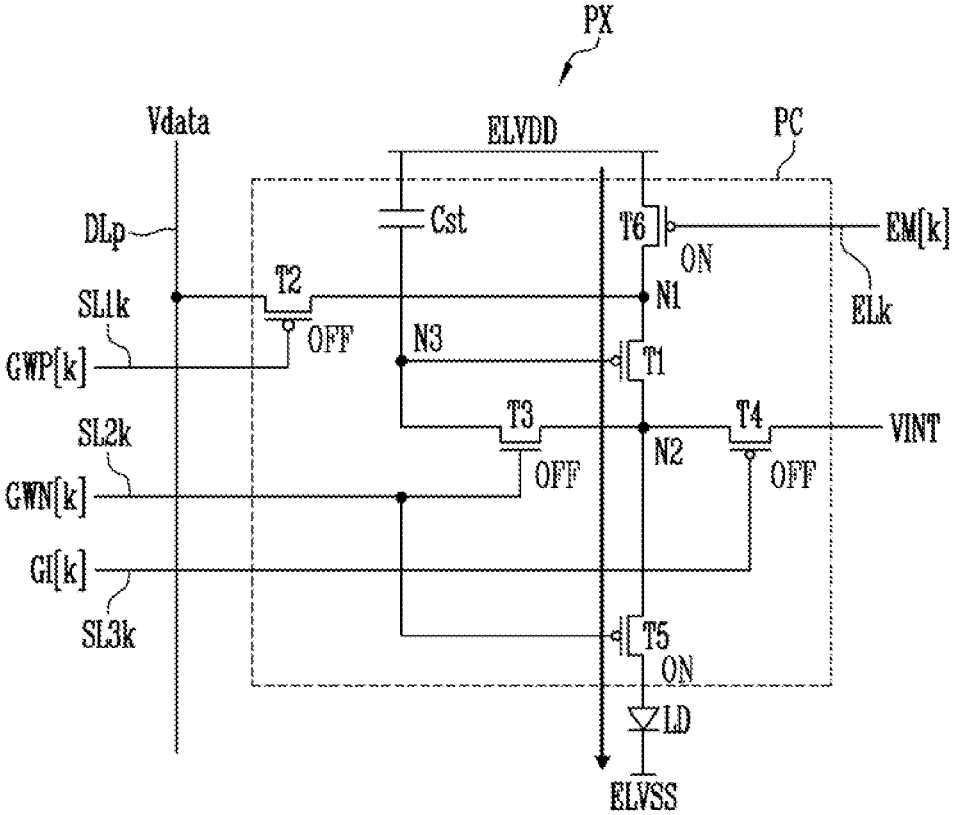
Figure 7:
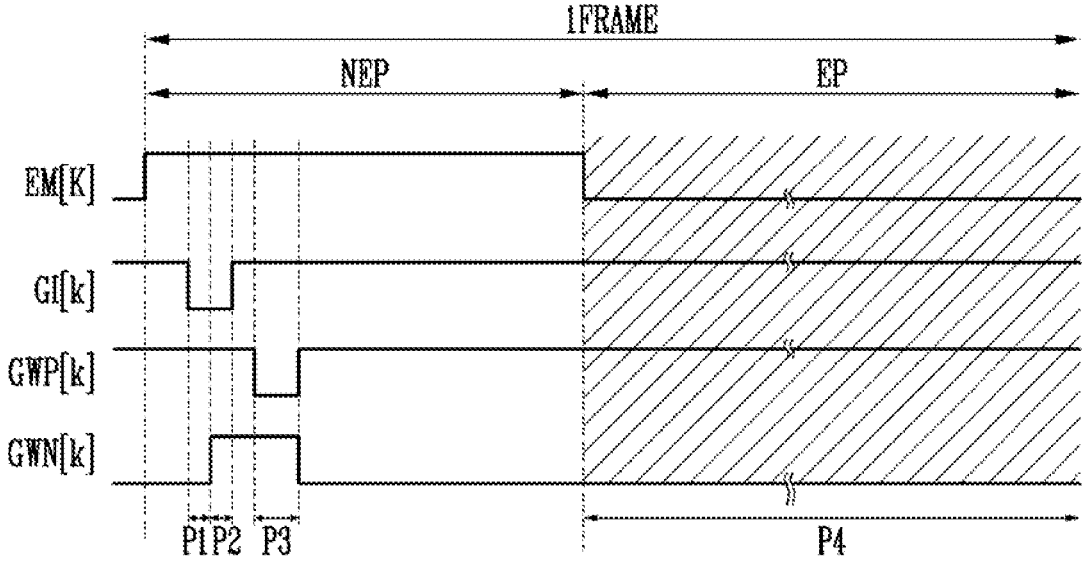

Referring to FIG. 7, in the fourth period P4, the emission control signal EM[k] of the logic low level may be supplied to the emission control line ELk. When the emission control signal EM[k] of the logic low level is supplied to the emission control line ELk, the sixth transistor T6 may be turned on. When the sixth transistor T6 is turned on, the first power source ELVDD and the first electrode of the first transistor T1 may be electrically connected.

In this case, when the second scan signal GWN[k] of the logic low level supplied to the second scan line SL2*k* is maintained, the third transistor T3 may maintain the turn-off state and the fifth transistor T5 may maintain the turn-on state. Accordingly, in the fourth period P4, a predetermined current may be supplied from the first transistor T1 to the light emitting diode LD in response to the voltage of the third node N3. This is illustrated by the arrow in FIG. 7. In this case, the light emitting diode LD may generate light having a predetermined luminance corresponding to the amount of current supplied from the first transistor T1.

Hereinafter, other exemplary embodiments of the present invention will be described. Difference between the following embodiments and the above-described embodiment will be mainly described.

Figure 8:
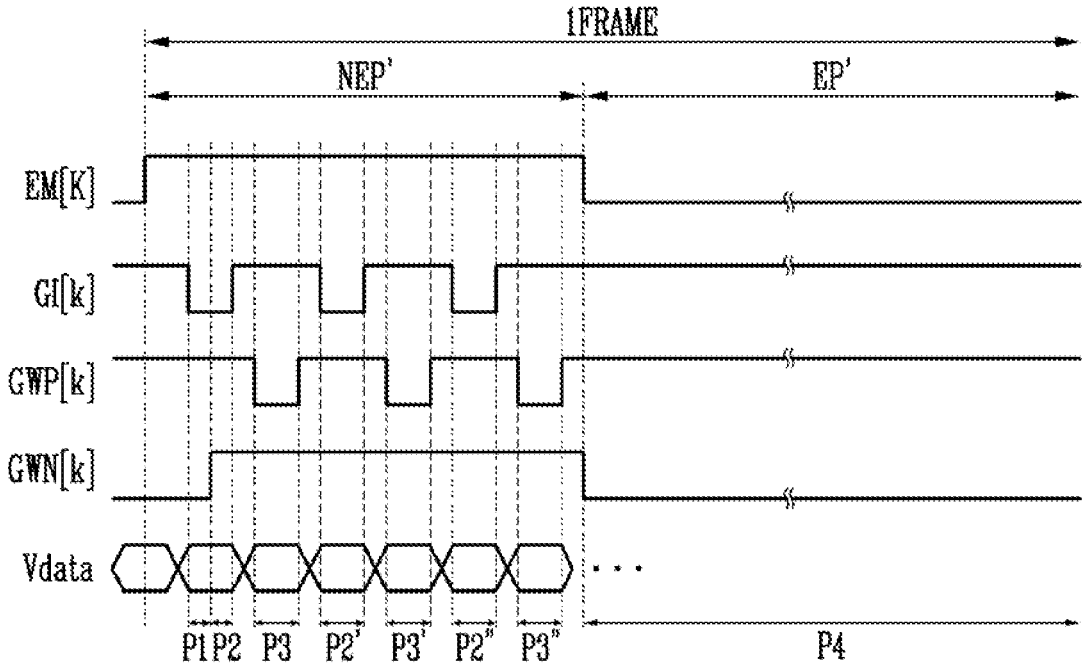
FIG. 8 is a timing diagram of driving the display device shown in FIG. 1, according to an exemplary embodiment of the present invention.

FIG. 8 is a timing diagram of driving the display device shown in FIG. 1, according to an exemplary embodiment of the present invention.

Referring to FIGS. 1, 2 and 8, one frame period of the display device 1000 may include an emission period EP' and a non-emission period NEP'.

The non-emission period NEP' may be divided into a first period P1, a second period P2, a (2-1)th period P2', a (2-2)th period P2", a third period P3, a (3-1)th period P3', and a (3-2)th period P3" for driving, and the emission period EP' may include a fourth period P4.

During the non-emission period NEP', the emission control signal EM[k] of the logic high level may be supplied to the emission control line ELk. When the emission control signal EM[k] of the logic high level is supplied to the emission control line ELk, the sixth transistor T6 may be turned off. When the sixth transistor T6 is turned off, current does not flow from the first power source ELVDD to the first transistor T1. Accordingly, the light emitting diode LD may maintain the non-light emitting state.

During the non-emission period NEP', two or more scan pulses of the first scan signal GWP[k] (hereinafter, first scan pulses) may be supplied to the first scan line SL1*k*, and two or more scan pulses of the third scan signal GI[k] (hereinafter, third scan pulses) may be supplied to the third scan line SL3*k*.

In FIG. 8, the lengths of the emission period EP' and the non-emission period NEP' included in one frame period are shown similarly to each other. However, it should be understood that the length of the emission period EP' is substantially longer than the length of the non-emission period NEP'.

In addition, the length of the non-emission period NEP' shown in FIG. 8 may be the same as the length of the non-emission period NEP shown in FIG. 3. However, the length of the non-emission period NEP' shown in FIG. 8 is not limited thereto, and may be longer than the length of the non-emission period NEP shown in FIG. 3. In addition, the length of the emission period EP' shown in FIG. 8 may be shorter than the length of the emission period EP shown in FIG. 3.

According to an exemplary embodiment of the present invention, during the non-emission period NEP', three scan pulses of each of the first scan signal GWP[k] and the third scan signal GI[k] (in other words, three first scan pulses and three third scan pulses) may be supplied to the pixel PX. For example, three first scan pulses and three third scan pulses may be supplied alternately.

In addition, during the non-emission period NEP', one scan pulse of the second scan signal GWN[k] (hereinafter, one second scan pulse) may be supplied to the pixel PX. In this case, while one second scan pulse is maintained, three first scan pulses may be supplied, and all of the third scan pulses may be supplied, except for a portion of the first pulse of the three third scan pulses.

In the first period P1, the first pulse among the three third scan pulses may be supplied at the logic low level to turn on the fourth transistor T4, and the second scan signal GWN[k] of the logic low level may be supplied to turn on the fifth transistor T5. Therefore, the anode of the light emitting diode LD may be initialized to the third power source VINT.

In the second period P2, the second scan pulse may be supplied at the logic high level. Thereafter, the second scan pulse may be maintained during the non-emission period NEP'. When the second scan pulse of the logic high level is supplied, the third transistor T3 may be turned on to initialize the third node N3. Thereafter, during the (2-1)th period P2' and the (2-2)th period P2", second and third pulses among the three third scan pulses may be supplied to turn on the fourth transistor T4. Accordingly, the third node N3 may be initialized multiple times. In other words, the third node N3 is initialized each time the third scan pulse is supplied to turn on the fourth transistor T4.

During the third period P3 and the (3-1)th period P3', first and second pulses among the three first scan pulses may be supplied to turn on the second transistor T2. Accordingly, the data signal Vdata corresponding to a previous horizontal line (a previous row) may be supplied to the first node N1. In this case, the first transistor T1 may be initialized to the voltage of the first node N1 (in other words, the first transistor T1 is provided with a bias voltage).

During the (3-2)th period P3", a third pulse among the three first scan pulses may be supplied to turn on the second transistor T2. In this case, the data signal corresponding to the current pixel PX may be supplied to the first node N1. Accordingly, a voltage reduced by the threshold voltage of the first transistor T1 in the data signal corresponding to the current pixel PX may be stored in the storage capacitor Cst.

In general, the driving transistor (or the first transistor T1) included in the pixel PX may have a hysteresis characteristic in which a threshold voltage is shifted and current is changed according to a change in the gate voltage of the driving transistor. Due to the hysteresis characteristic of the driving transistor (or the first transistor T1), a current different from the current set in the pixel PX may flow according to a previous data signal of the corresponding pixel PX. Accordingly, the pixel PX does not generate light having a desired luminance in the current frame.

However, according to an exemplary embodiment of the present invention, when the first scan pulses and the third scan pulses are supplied multiple times, the gate voltage (and a gate-source voltage) of the first transistor T1 may be repeatedly changed. Therefore, a change in hysteresis of the first transistor T1 according to a difference between the voltage of the data signal of a previous frame and the voltage of the data signal of the current frame can be reduced. Accordingly, an instantaneous afterimage that may occur when a change in luminance is large can be removed or reduced.

In the fourth period P4, a control pulse (hereinafter, an emission control pulse) of the emission control signal EM[k] of the logic low level may be supplied to the emission control line ELk. When the emission control pulse of the logic low level is supplied to the emission control line ELk, the sixth transistor T6 may be turned on. When the sixth transistor T6 is turned on, the first power source ELVDD and the first electrode of the first transistor T1 may be electrically connected. Accordingly, the light emitting diode LD may generate light having a predetermined luminance corresponding to the amount of current supplied from the first transistor T1.

In the display device according to the exemplary embodiments of the present invention, a transistor positioned in a leakage path of the current in the unit pixel circuit may be formed of the oxide semiconductor transistor. Therefore, the leakage current can be minimized, and an image having a desired luminance can be displayed.

In addition, in the display device according to the exemplary embodiments of the present invention, the number of oxide semiconductor transistors used in the unit pixel circuit can be reduced. Therefore, a high resolution (or highly integrated the pixel circuit) display device can be realized.

While the present invention has been described with reference to exemplary embodiments thereof, those skilled in the art will appreciate that various changes in form and details may be made thereto without departing from the spirit and scope of the present invention as set forth in the following claims.

What is claimed is:

1. A display device, comprising:

a pixel connected to a first scan line, a second scan line, a third scan line, a data line, and an emission control line, wherein the pixel includes:

a light emitting diode;

a first transistor including a first electrode connected to a first node, a second electrode connected to a second node, and a gate electrode connected to a third node, wherein the first node is electrically connected to a first power source;

a second transistor connected between the data line and the first node and including a gate electrode connected to the first scan line;

a third transistor connected between the second node and the third node and including a gate electrode connected to the second scan line;

a fourth transistor connected between the second node and a third power source and including a gate electrode connected to the third scan line;

a fifth transistor connected between the second node and an anode of the light emitting diode and including a gate electrode connected to the second scan line; and a sixth transistor connected between the first node and the first power source and including a gate electrode connected to the emission control line, wherein the emission control line is different from the second scan line, wherein a turn-on period of the third transistor does not overlap a turn-on period of the fifth transistor, and wherein the third transistor is turned off and the fifth transistor is turned on during a first period in a period in which the fourth transistor is turned on, and the third transistor is turned on and the fifth transistor is turned off during a second period in the period in which the fourth transistor is turned on.

2. The display device of claim 1, wherein the first transistor, the second transistor, the fourth transistor, the fifth transistor, and the sixth transistor are P-type Low-Temperature Poly-Silicon (LTPS) thin film transistors, and wherein the third transistor is an N-type oxide semiconductor thin film transistor.

3. The display device of claim 1, further comprising:

a storage capacitor connected between the first power source and the third node.

4. The display device of claim 1, wherein a cathode of the light emitting diode is electrically connected to a second power source.

5. The display device of claim 4, wherein a voltage of the first power source is higher than a voltage of the second power source.

6. The display device of claim 1, further comprising:

a data driver for supplying a data signal corresponding to a grayscale of an image to the data line.

7. The display device of claim 6, wherein a voltage of the third power source is lower than a voltage of the data signal.

8. The display device of claim 1, further comprising:

a scan driver for supplying a first scan signal, a second scan signal, and a third scan signal to the first scan line, the second scan line, and the third scan line, respectively, during a frame period including a non-emission period and an emission period.

9. The display device of claim 8, wherein the non-emission period includes the first period in which the anode of the light emitting diode is initialized, the second period in which the gate electrode of the first transistor is initialized, and a third period in which the data signal supplied from the data line to the gate electrode of the first transistor is stored, and wherein the emission period includes a fourth period during which the light emitting diode emits light.

10. The display device of claim 9, Wherein during the first period, the second scan signal has a logic low level, and the third scan signal has the logic low level.

11. The display device of claim 9, wherein during the second period, the second scan signal has a logic high level, and the third scan signal has a logic low level.

12. The display device of claim 9, wherein during the third period, the first scan signal has a logic low level, and the second scan signal has a logic high level.

13. The display device of claim 8, wherein during the non-emission period, the first scan signal and the third scan signal are alternately supplied, and the second scan signal and the third scan signal are supplied to overlap in some periods.

14. The display device of claim 1, further comprising:

an emission driver for supplying an emission control signal to the emission control line, wherein the emission control signal of a logic high level is supplied during the non-emission period, and the emission control signal of a logic low level is supplied during the emission period.

15. The display device of claim 1, further comprising:

a scan driver for supplying two or more first scan pulses, one second scan pulse, and two or more third scan pulses to the first scan line, the second scan line, and the third scan line, respectively, during a frame period including a non-emission period and an emission period.

16. The display device of claim 15, further comprising:

an emission driver for supplying an emission control pulse to the emission control line during the non-emission period.

17. The display device of claim 15, wherein during the non-emission period, the first scan pulses and the third scan pulses are alternately supplied, and a first scan pulse among the two or more third scan pulses partially overlaps the second scan pulse.

18. The display device of claim 15, wherein in the emission period, the light emitting diode emits light at a grayscale corresponding to a voltage of the third node when the last scan pulse among the two or more first scan pulses is supplied.

19. A display device, comprising:

a pixel, wherein the pixel includes:

a light emitting diode;

a first transistor including a first electrode connected to a first node, a second electrode connected to a second node, and a gate electrode connected to a third node;

a second transistor connected between a data line and the first node, wherein a gate of the second transistor is connected to a first scan line;

a third transistor connected between the second node and the third node, wherein a gate of the third transistor is connected to a second scan line;

a fourth transistor connected between the second node and a third power source, wherein a gate of the fourth transistor is connected to a third scan line; and a fifth transistor connected between the second node and an anode of the light emitting diode, wherein a gate of the fifth transistor is connected to the second scan line, wherein a type of the third transistor is different from a type of the fifth transistor, and wherein a turn-on period of the third transistor does not overlap a turn-on period of the fifth transistor, and wherein the third transistor is turned off and the fifth transistor is turned on during a first period in a non-emission period in which the fourth transistor is turned on, and the third transistor is turned on and the fifth transistor is turned off during a second period in the non-emission period in which the fourth transistor is turned on, wherein the display device further comprises:

a scan driver for supplying two or more first scan pulses, one second scan pulse, and two or more third scan pulses to the first scan line, the second scan line, and the third scan line, respectively, during a frame period including the non-emission period and an emission period.

* * * * *